US005225114A

United States Patent [19]

Anderson et al.

[11] Patent Number: 5,225,114

[45] Date of Patent: Jul. 6, 1993

[54] MULTIPURPOSE CONTAINER FOR LOW-LEVEL RADIOACTIVE WASTE

[75] Inventors: Robert T. Anderson, Aiken; Samuel D. Pearson, Lexington, both of S.C.

[73] Assignee: Chem-Nuclear Systems, Inc., Columbia, S.C.

[21] Appl. No.: 763,655

[22] Filed: Sep. 18, 1991

[51] Int. Cl.[5] ..... G21F 9/22

[52] U.S. Cl. ..... 252/633; 250/506.1; 250/507.1; 376/272

[58] Field of Search ..... 252/633; 250/506.1, 250/507.1; 376/272; 423/DIG. 20

[56] References Cited

U.S. PATENT DOCUMENTS

| | | | |
|---|---|---|---|
| 3,257,912 | 3/1981 | Fleischer et al. | 252/626 |
| 4,100,860 | 7/1978 | Gablin et al. | 109/83 |
| 4,229,316 | 10/1980 | Baatz et al. | 252/626 |
| 4,476,657 | 10/1984 | Juba et al. | 52/139 |
| 4,530,783 | 7/1985 | Arcuri et al. | 252/628 |
| 4,594,513 | 6/1986 | Suzuki et al. | 250/505.1 |
| 4,783,309 | 11/1988 | Popp et al. | 376/272 |
| 4,818,878 | 4/1989 | Popp et al. | 250/507.1 |
| 4,923,088 | 5/1990 | Tanaka et al. | 220/468 |
| 4,972,087 | 11/1990 | Neider et al. | 250/507.1 |
| 4,996,019 | 2/1991 | Catalayoud et al. | 376/272 |
| 5,102,615 | 4/1992 | Grande et al. | 376/272 |

*Primary Examiner*—Donald P. Walsh
*Assistant Examiner*—Ngoclan T. Mai
*Attorney, Agent, or Firm*—Allegretti & Witcoff, Ltd.

[57] ABSTRACT

A method and an apparatus for the disposal of low-level radioactive wastes are disclosed. Under the disclosed method, the waste is first introduced into a preconstructed multipurpose container which comprises a polyethylene inner container disposed within an outer concrete shell. Processing of the waste is carried out within the multipurpose container. The filled container is then transported to a disposal site, followed by storage of the waste at the storage disposal site.

The claimed apparatus comprises an empty multipurpose storage container for use in the method. The multipurpose container is adapted for receiving and storing low-level radioactive waste, and comprises a polyethylene inner container disposed within an outer concrete shell. The multipurpose container is suitable for use during the processing and collection of low-level radioactive waste at the generation site, provides sufficient protection during transportation, and can serve as the permanent storage container upon delivery of the container to a remote disposal site.

9 Claims, 3 Drawing Sheets

MULTIPURPOSE CONTAINER FOR LOW-LEVEL RADIOACTIVE WASTE

BACKGROUND OF THE INVENTION

1. Field of the Invention

This invention relates to a novel method and apparatus for containing and storing low-level radioactive wastes, such as those that are generated in the nuclear power industry.

2. Description of the Related Art

Low-level radioactive wastes are typically disposed of at a different location than where they were generated. Thus, the waste must be contained through at least three distinct stages of the disposal process: processing and temporary storage of the waste at the generation site, transportation of the waste to the disposal site, and permanent containment of the waste at the final disposal site. Each of these stages presentsm different problems and requirements with respect to the containment of the waste.

During the first stage, processing and storage of the waste at the facility where it is generated, several factors are important. First, and most importantly, the container in which the waste is stored should be able to accommodate various types of waste processing equipment, discussed more fully herein. Next, it is important that the waste container be easy to handle and move about within the facility. Finally, the container should provide adequate shielding from radiation.

During the next stage of the disposal process, transportation of the waste to a disposal site, radiation shielding is of primary concern. The container must also provide protection against spillage while in transit, and, more specifically, must meet specific Department of Transportation regulations relating to the transportation of low-level hazardous wastes.

For the final stage of the disposal process, the container must be adapted to both contain the waste and provide shielding from radiation for up to several hundred years. Ease of handling, on the other hand, is of diminished importance.

Because each stage of the disposal process places different requirements on the waste container, a container that is ideally suited for use during one stage might be totally insufficient for use during another stage of the process.

Industry has typically responded to this problem by using a different containment scheme for each stage of the waste disposal process. The most widely used approach has been to hold the waste in a single primary container, such as a polymeric drum, throughout the disposal process, and combine the primary container with different components at each stage of the disposal process in order to meet the needs of that stage. Under this approach, the primary container is typically used alone during the processing and temporary storage of the waste at the generation site. The container may also be placed into or surrounded by a portable shield during this stage in order to protect workers from radiation. During the next stage of the disposal process, shipment of the waste to a disposal site, the primary container is placed inside of a protective shipping cask, typically made of lead and steel. Finally, at the disposal site, the primary container is removed from the cask and placed into another container prior to permanent storage or underground burial. This final container, often referred to as an overpack, may be made from any of a variety of materials, including concrete.

While this approach allows the individual containment requirements of each stage of the disposal process to be met, it has several disadvantages. First, the approach requires the use of a number of different types and designs of containers, casks, and overpacks. Since the components exist in a variety of shapes and sizes, care must be taken to ensure that they will be compatible with each other.

A further disadvantage of the above-described approach is that each container, cask, and overpack must be independently produced, transported, and stored before, and in some instances, after it is used. For instance, after the waste has been delivered to the disposal site, the empty casks must be removed from the site and shipped away for reuse with a compatible primary container.

A further disadvantage to this approach is that it requires excessive handling of the waste. At each stage of the waste disposal process, the primary container must be physically lifted off of the ground in order to either place it into or remove it from a cask or overpack. The risk of accidental spillage is increased each time the primary container is lifted.

Another disadvantage to this approach is that a considerable gap must be left between the outer surface of the primary container and the inner surface of the cask or overpack, in order to enable the primary container to be lifted easily into and out of the shipping cask or overpack. This results in wasted storage space, an important consideration given the fact that storage space for radioactive waste is at a premium.

Another disadvantage to this system is that since the filled primary container is at times not inside of a cask or overpack, and since even when it is inside of a cask or overpack, the cask or overpack provides no direct structural support to the container to assist it in withstanding the outward forces that are imparted on it by the contained waste, the primary container must strong enough, by itself, to withstand all such forces. Thus, when it is combined with a shipping cask or overpack, there is a great deal of structural redundancy in the system.

SUMMARY OF THE INVENTION

As discussed above, there are a number of problems that are inherent in the approaches that have heretofore been used in the disposal of low-level radioactive waste. Therefore, a need has arisen for a new method and apparatus for disposing of low-level radioactive waste that eliminates the need for using multiple containers, and yet meets the various containment needs that are presented throughout the wasted disposal process.

It is thus a primary object of the present invention to provide such a method and apparatus. Specifically, it is an object of this invention to provide a method based upon the use of a single multipurpose containment apparatus that may be easily handled, that is rugged and reliable so that it may be used in transporting radioactive wastes, and that will safely contain such wastes over extremely long periods of time.

It is a further object of the present invention to provide a process for disposing of low-level radioactive waste that avoids the logistical problems associated with the use in combination of a number of different containers at various stages of the disposal process.

It is a further object of this invention to provide a process for disposing of low-level radioactive waste that does not require the repeated lifting of a primary container into and out of various outer containers.

Finally, it is an object of this invention to provide a multipurpose container for low-level radioactive waste that maximizes the amount of waste that can be stored within a given stored volume, while minimizing the amount of structural redundancy inherent in the containment system.

These and a number of other advantages are provided by the invention set forth herein, which relates generally to both a method and an apparatus for the disposal of low-level radioactive wastes. In a basic aspect, the claimed method comprises introducing the waste into a preconstructed multipurpose container at a first location, the multipurpose container comprising a polyethylene inner container disposed within an outer concrete shell, transporting the multipurpose container to a disposal site, and storing the multipurpose container at the storage disposal site.

The claimed apparatus, in a basic aspect, comprises an empty multipurpose storage container for use in the method. The multipurpose container is adapted for receiving and storing low-level radioactive waste, and comprises a polyethylene inner container disposed within an outer concrete shell. The multipurpose container, once filled, is suitable for use during the processing of low-level radioactive waste at the generation site, provides sufficient protection during transportation, and can serve as the permanent storage container for the waste upon delivery of the container to a remote disposal site.

DETAILED DESCRIPTION OF SPECIFIC EMBODIMENTS

Figure 1:
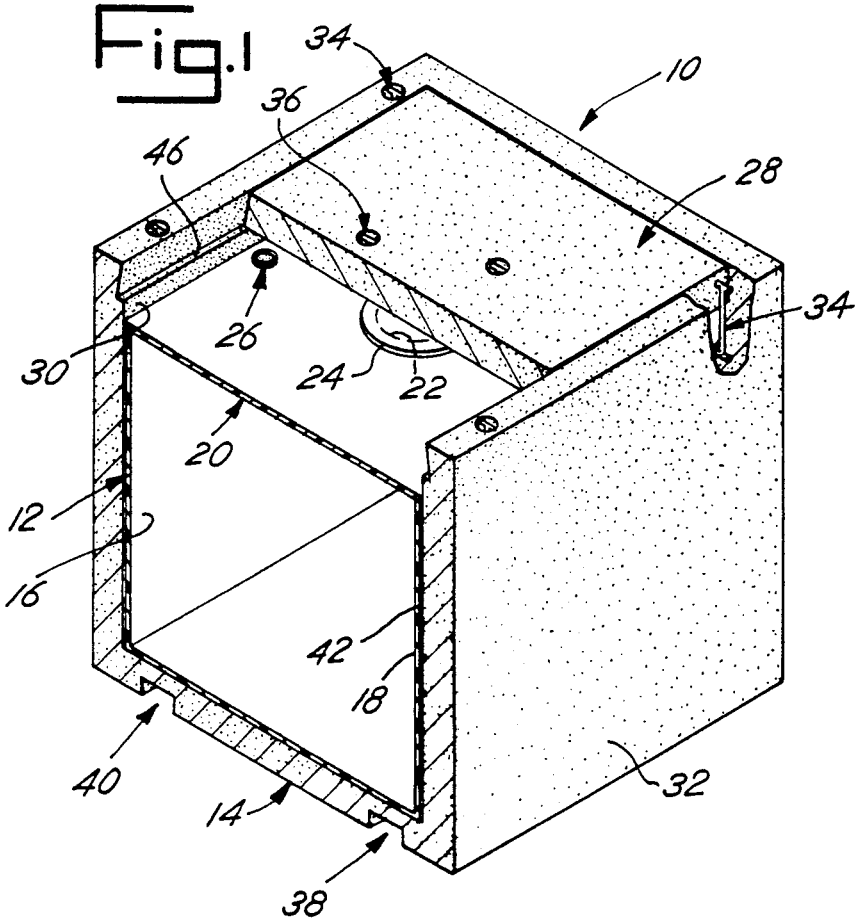
FIG. 1 of the drawing is a cross-sectional perspective view of an empty multipurpose container.

As shown in FIG. 1 of the drawing, the claimed apparatus is a multipurpose container 10 that comprises a polymeric inner container 12 disposed within a concrete outer shell 14. The polymeric inner container 12 is preferably composed of linear polyethylene, i.e., high density polyethylene in which the polyethylene chains are relatively straight and closely aligned. The polymeric inner container 12 has, in general, an inner surface 16 and an outer surface 18. The polymeric inner container has a primary lid, 20, also composed of polymer. The primary lid 20 contains an opening 22. The primary lid 20 is fastened to the polymeric inner container by heat welding, a well-known process. A smaller secondary lid, 24, is used to cover the opening 22. Also contained in the primary lid 20 is a high efficiency particulate filter, or HEPA filter 26, which allows gases to vent into and out of the container, while shutting in radioactive particles. The concrete outer shell 14 also has a lid 28, an inner surface 30, and an outer surface 32.

The polymeric inner container 12 is typically manufactured in any of a number of manners, such as by injection molding, or by heat welding individual sheets of polyethylene together. Preferably, however, the polymeric inner container is manufactured by a rotomolding process.

The concrete outer shell 14 is typically made through a precasting process, and is metal reinforced. The concrete may be reinforced with epoxy coated wire mesh or reinforcement bar. The concrete may also have various additives admixed into it during the concrete blending procedure. Such additives may include various high range water reducing agents, or pozzolanic materials such as fly ash and silica fume. The concrete may also be a reinforced, for instance, with amorphous metal fibers obtained from SOGEFIBRE of France. Such fibers are generally produced by quenching a liquid metal jet onto a cooled wheel that is rotating at a high speed. The resulting metal fibers are noncrystalline in structure, and thus highly corrosion resistant.

Figure 2:
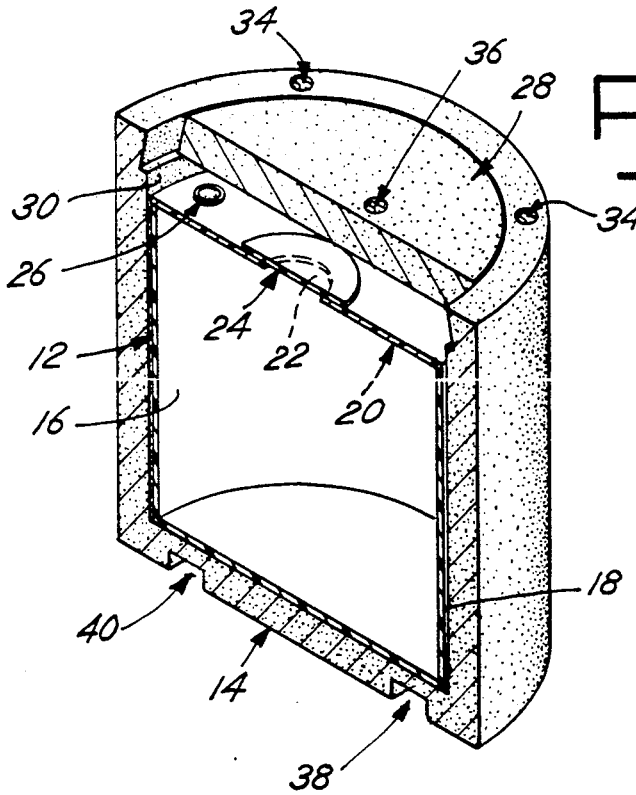
FIG. 2 of the drawing is a cross-sectional perspective view of an empty cylindrical multipurpose container.

Various hooks and lifting pins can be embedded into the concrete outer shell during its casting. For instance, body lift pins 34 can be provided in order to allow the container to be lifted. Lid lift pins 36 can similarly be cast into the lid 28. A pair of forklift notches 38 and 40 are preferably cast into the bottom of the concrete outer shell, into which the forks of a forklift can be inserted in order to allow the container to be safely lifted. Finally, in order to provide protection from radiation, shielding 42 (not shown) can be placed within the container 10, for instance between each outer surface 18 of the inner container 12 and the adjacent inner surface 30 of the outer shell 14. This shielding 42 can be fabricated from steel, iron, lead, high density concrete, or combinations thereof. An alternative embodiment of the claimed apparatus, differing only in that its shape is cylindrical, is shown in FIG. 2.

Figure 3:
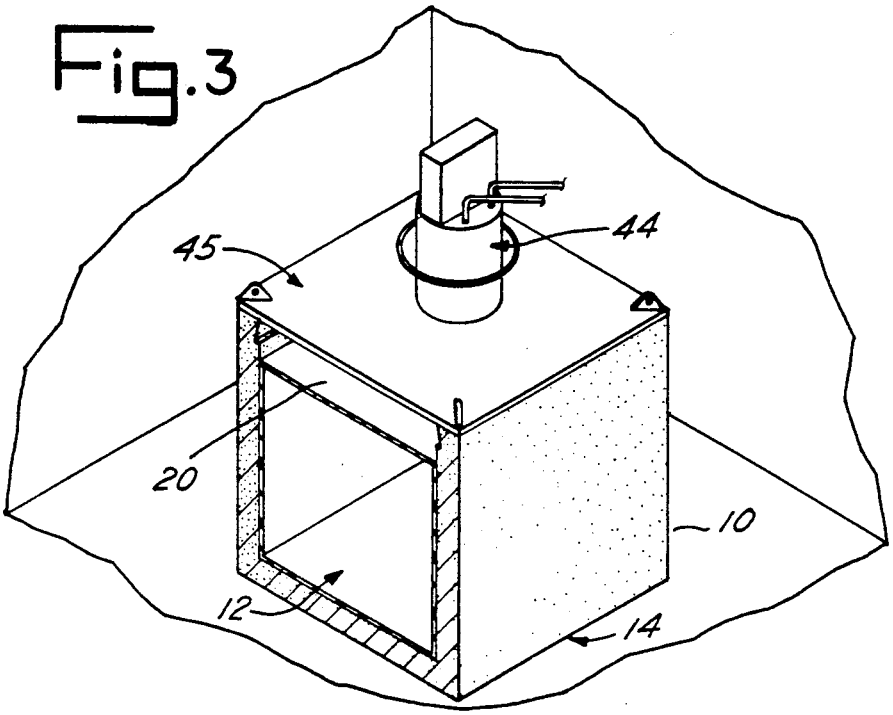
FIG. 3 of the drawing is a cross-sectional perspective view of a multipurpose container with a fillhead positioned in place.

Turning now to FIG. 3, the claimed multipurpose container is seen as it exists during the first stage of the claimed process, the processing and storage stage.

Prior to shipment of the multipurpose container to the processing location, various processing devices (not shown) are placed into the inner container 12. These devices may include mixers or filter elements that are used in order to further treat low-level radioactive waste once it is introduced into the container. Such treatment may include mixing the waste within the container while adding chemical conditioners in order to form a stabilized waste form, or suctioning through a filter element in order to evacuate water from the container while leaving the radioactive waste behind. Such treatment devices and procedures are generally known. After the processing devices are positioned inside of the container, the lid 20 is heat welded into place. With this step, the processing devices are essentially sealed into the container, where they remain. The secondary lid 24, however, is not yet sealed into place over the opening 22.

At the processing location, a fillhead 44 is placed into the opening 22 in the secondary lid 20. The fillhead 44 is supported by a process lid 45, which rests on the top of the concrete outer shell 14. The fillhead serves several purposes. First, waste material is introduced through the fillhead into the inner container 12. Additives, such as those used to condition the waste for stabilization, may also be added through the fillhead into the inner container. The fillhead also provides the necessary connections to the various processing devices that are located within the inner container 12. For instance, suction lines that run from a dewatering pump into the fillhead are connected at the fillhead onto pipes inside of the inner container, which are in turn connected to the various filter elements.

After the waste has been introduced into the container and processed, the fillhead 44 is withdrawn from the opening 22, which is then covered and sealed with the secondary lid 24. The sealing of the lid is typically carried out at the processing location. In order to simplify the attachment of the secondary lid 24 onto the lid 20, a wire, coated with polyethylene, may be positioned around the outer edge of the secondary lid 24. After the secondary lid 24 is positioned in place over the opening 22, the ends of the wire are connected to an electrical current. This causes the wire to heat up, melting the polyethylene coating, and welding the secondary lid 24 onto the lid 20. The waste is now fully sealed within the inner container 12.

Figure 4:
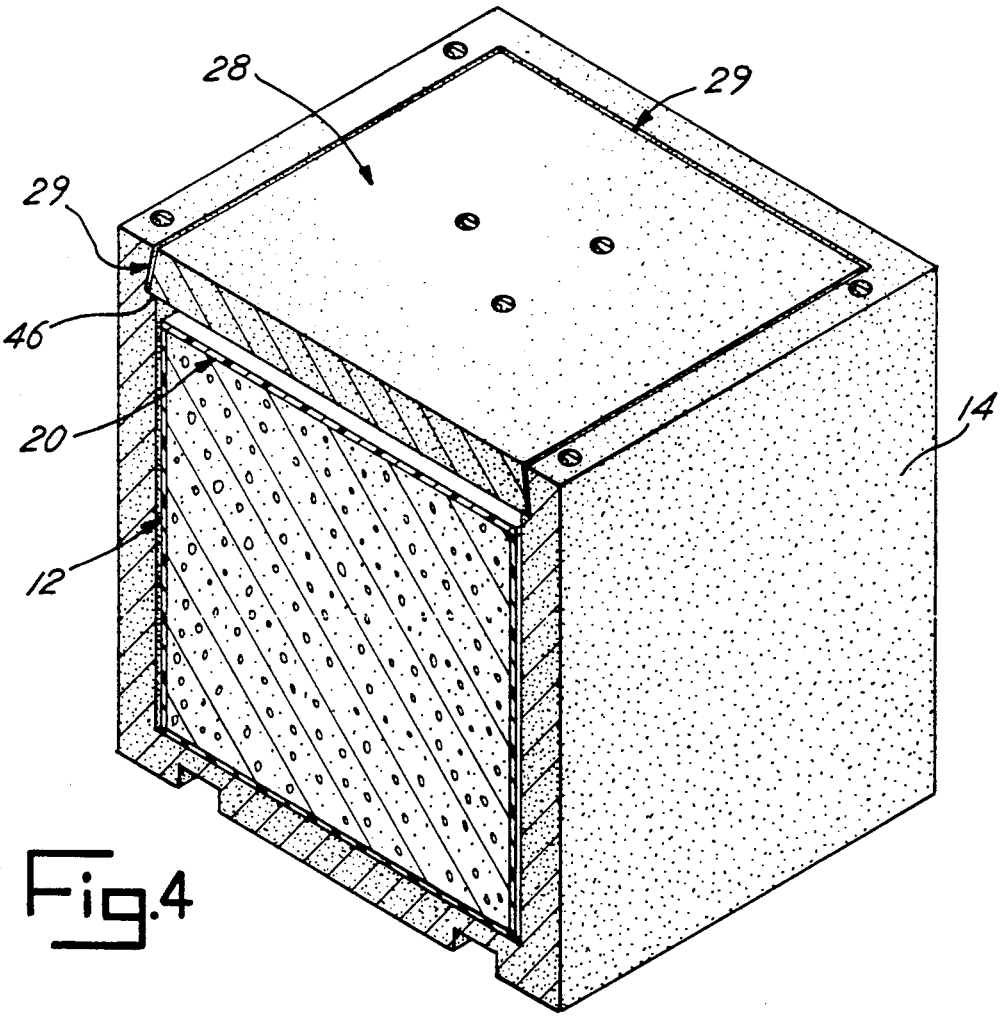
FIG. 4 of the drawing is a cross-sectional perspective view of a filled multipurpose container with its concrete lid in place.

Turning now to FIG. 4, the lid 28 is now positioned onto the concrete shell 14, resting on a lip 46, also shown in FIG. 1. The lid 28 can be grouted into place at this time by inserting grout into the gap 29 between the lid 28 and the outer shell 14. Alternatively, the lid can be left ungrouted, if it is likely that it will be removed at some future time, for instance if a final inspection of the inner container is to be conducted immediately prior to disposal. The multipurpose container is now in condition to be either stored on site, or to be transported to another location for disposal.

Figure 5:
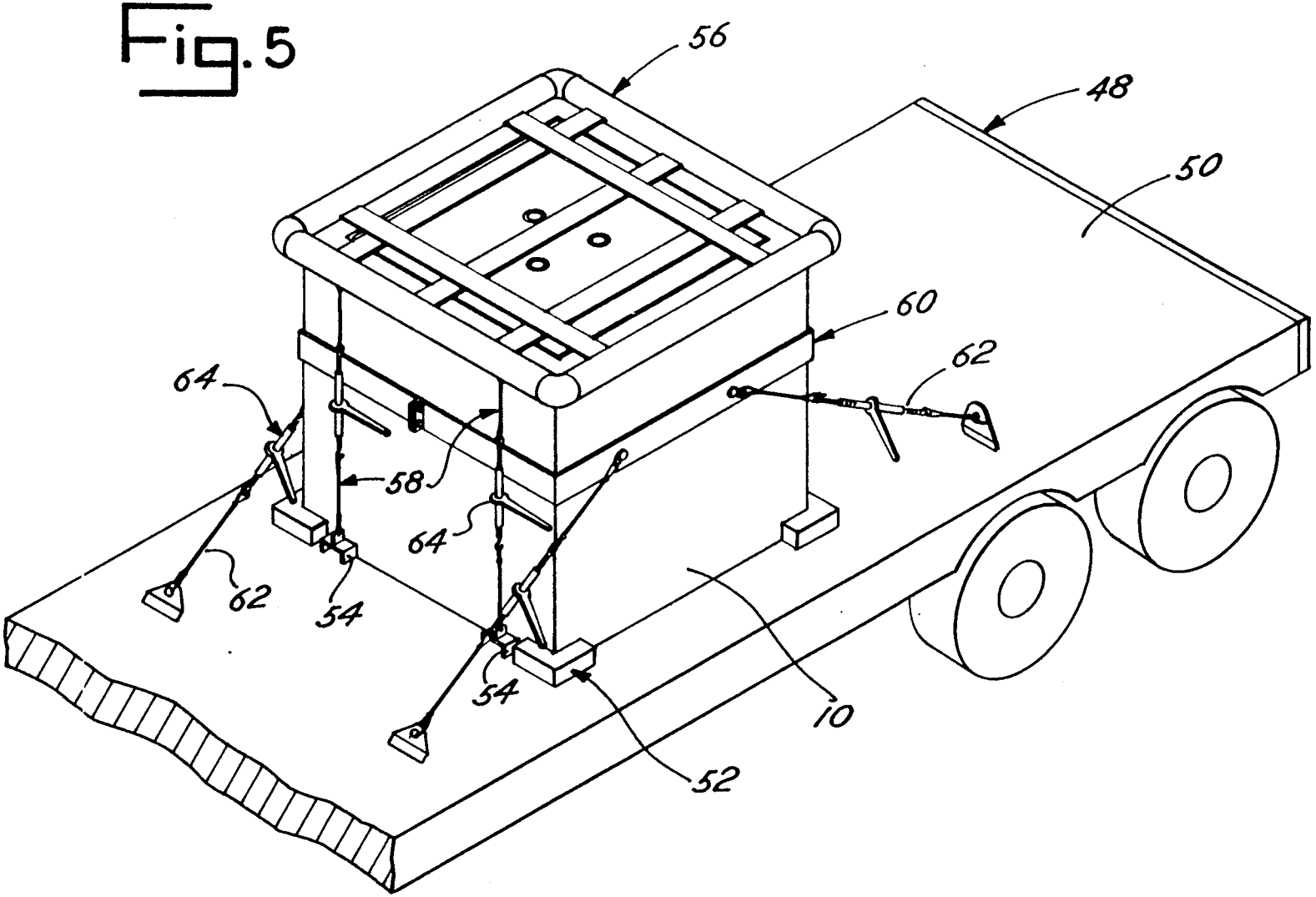
FIG. 5 of the drawing illustrates the details of an assembly for securing a filled multipurpose container onto the bed of a flatbed vehicle.

Turning now to FIG. 5, a manner of securing the filled multipurpose container 10 onto a flatbed vehicle 48 is shown. The filled container 10 is place onto the bed 50 of the vehicle 48, being held generally in place by a number of chocks 52. A beam 54 is passed through each forklift notch 38 and 40, extending slightly out of the notch. An impact limiter 56 is placed over the top of the container 10, and is held in place by a number of cables 58, each of which passes from the impact limiter to one of the beams 54. A container restraining band 60, preferably made of performed steel, is placed around the multipurpose container, with its ends bolted together tightly. A number of tie-down cables 62 extend from the container restraining band 60 to the bed 50 of the vehicle. The cables 58 and 62 are each provided with a tensioning apparatus 64, such as a ratchet binder.

After the filled container has been transported to the disposal site, it is disposed of in any of the known manners. The multipurpose container is appropriate for burial, for storage in warehouses, or for any of a number of other methods for storing or disposing of low-level radioactive waste.

In light of the above disclosed process, it is readily apparent that it is not necessary to remove the inner container 12 from the outer concrete shell 14 at any time during the process. Thus, the concrete shell, either alone or in combination with a radiation shield, can be relied upon at all times to provide structural support for the polyethylene inner container. As a result, the inner container can be constructed with thinner walls than would be required if it had to removed from the outer shell at any time. Thus, while a freestanding polyethylene container full of liquid waste would typically have a wall thickness of at least one half inch, the inner container of the present multipurpose container can be as thin as one quarter inch.

Furthermore, since there is typically very little gap between the inner container and the outer shell of the multipurpose container, the amount of waste that can be contained within a given stored volume is considerably greater than for a typical container that is placed inside of a concrete overpack prior to disposal, in which a considerable gap is left between the container and overpack.

While the preferred embodiments of the claimed method and apparatus have been described, and various alternative embodiments have been suggested, it should be understood that other embodiments could be devised based upon the principles of the claimed method and apparatus of this invention that would remain within the spirit of the invention and the scope of the appended claims.

What we claim is:

1. A method for disposing of low-level radioactive waste, comprising the steps of a) introducing the waste into a multipurpose container, the multipurpose container comprising a polymeric inner container disposed within a concrete outer shell, the shape of the inner container conforming substantially to the shape of the outer shell's inner surface, b) transporting the waste in the same multipurpose container to a storage location, and c) storing the container at the storage location.

2. The method of claim 1, in which the polymeric inner container is composed of linear polyethylene.

3. The method of claim 1 in which the concrete shell is reinforced with metal.

4. The method of claim 1, in which a radiation shield is placed within the multipurpose container prior to storage, the radiation shield being positioned between the outer surface of the polymeric inner container and the inner surface of the concrete shell.

5. The method of claim 1, in which the shape of the inner container's outer surface conforms substantially to the shape of the outer shell's inner surface.

6. The method of claim 1, wherein the inner container has a removable lid.

7. The method of claim 6, wherein the lid has a removable secondary lid.

8. The method of claim 1, wherein the outer shell has a removable lid.

9. A method of disposing of low-level radioactive waste, comprising introducing the waste into a preconstructed multipurpose container at a first location, the multipurpose container comprising a polyethylene inner container disposed within an outer concrete shell, transporting the container to a storage location, and storing the container at the storage location.

* * * * *